US007805959B2

(12) United States Patent
Webb et al.

(10) Patent No.: US 7,805,959 B2
(45) Date of Patent: Oct. 5, 2010

(54) CUP HOLDER FOR DRINKING GAME

(76) Inventors: Matthew B. Webb, 122 Robin Ave., Richmond, VA (US) 23223; Robert L Kent, III, 3624 Sparrow Pond La., Raleigh, NC (US) 27606

( * ) Notice: Subject to any disclaimer, the term of this patent is extended or adjusted under 35 U.S.C. 154(b) by 689 days.

(21) Appl. No.: 11/598,802

(22) Filed: Nov. 14, 2006

(65) Prior Publication Data

US 2007/0107460 A1 May 17, 2007

Related U.S. Application Data

(60) Provisional application No. 60/735,845, filed on Nov. 14, 2005.

(51) Int. Cl.
*F25D 3/08* (2006.01)

(52) U.S. Cl. ..... 62/457.3; 62/530

(58) Field of Classification Search ..... 62/457.1, 62/457.3, 530, 371
See application file for complete search history.

(56) References Cited

U.S. PATENT DOCUMENTS

| | | | | |
|---|---|---|---|---|
| 2,810,276 | A | 10/1957 | Murray | |
| 3,091,091 | A | 5/1963 | Ferrante | |
| 3,286,483 | A | 11/1966 | Burg | |
| 4,304,106 | A | 12/1981 | Donnelly | |
| 4,989,419 | A | 2/1991 | Brando et al. | |
| 5,088,301 | A | 2/1992 | Piepenbrink | |
| 5,165,583 | A | 11/1992 | Kouwenberg | |
| 5,201,194 | A * | 4/1993 | Flynn et al. | 62/457.3 |
| 5,212,963 | A | 5/1993 | McGinnis | |
| D379,135 | S | 5/1997 | Vina | |
| 5,934,099 | A | 8/1999 | Cook et al. | |
| 6,035,659 | A * | 3/2000 | Fernandez | 62/457.4 |
| 6,067,813 | A * | 5/2000 | Smith | 62/371 |
| 6,446,460 | B1 | 9/2002 | Rosenberg | |
| 6,786,062 | B1 | 9/2004 | Greenberg | |
| 6,851,276 | B2 | 2/2005 | Perrins | |
| 2003/0150238 | A1 | 8/2003 | Dais et al. | |
| 2003/0230110 | A1 | 12/2003 | Linberg et al. | |
| 2005/0029747 | A1 | 2/2005 | Grayson | |

FOREIGN PATENT DOCUMENTS

| | | |
|---|---|---|
| JP | 4-227449 | 12/1991 |

OTHER PUBLICATIONS http://www.lafumarccliners.com/Purchase Drink Holder.htm "Drink Holder" retrieved on Jul. 20, 2005.

* cited by examiner

*Primary Examiner*—Melvin Jones
(74) *Attorney, Agent, or Firm*—Richard C. Litman

(57) ABSTRACT

The cup holder for a drinking game is a triangular multi-cup beverage tray and freezer pack insert that holds and chills multiple cups in a "billiard ball rack" formation for use in the drinking game "Beer-Pong," "Beirut," or variations thereof. The cup holder for a drinking game includes cup pockets, indentations or channels in a triangular row formation (front to back) of one cup, two cups, three cups, etc., which are formed in the freezer pack The cup holding freezer pack fits into the triangular tray for added stability. Rubber or neoprene feet are disposed symmetrically on an underside of the bottom of the tray to provide traction during use. Preferably, the placement and depth of the cup pockets provide for the correct orientation of the cups for optimal playing of the drinking game with standard 16-ounce party cups.

16 Claims, 4 Drawing Sheets

CUP HOLDER FOR DRINKING GAME

CROSS-REFERENCE TO RELATED APPLICATION

This application claims the benefit of U.S. Provisional Patent Application Ser. No. 60/735,845, filed Nov. 14, 2005.

BACKGROUND OF THE INVENTION

1. Field of the Invention

The present invention relates to cup holders, and particularly to a cup holder for a drinking game known as "Beer-Pong" or "Beirut," the cup holder providing for quick and accurate placement of the cups and for keeping the beverage (typically beer) chilled during play of the game.

2. Description of the Related Art

Beer-Pong, or Beirut, is a drinking game that is a popular party game, particularly among young people, such as college students. Although there are many local variations in the rules of the game, typically the game comprises two teams of two people each. The game is played on a conventional ping-pong table, or a table similar in dimensions to a ping-pong table, but without the net across the center of the table. The teams have a group of drinking cups, e.g., 16-ounce cups, arranged in a close fitting triangular pattern, similar to racked billiard balls, placed centrally at opposite ends of the table. The cups are filled, or half-filled, with a beverage, typically beer, although malt liquor or other alcoholic or nonalcoholic beverages may be substituted therefor.

The purpose of the game is for each team to take turns trying to eliminate the other team's cups by throwing or bouncing ping-pong balls into the cups. Any cup that a ping-pong ball falls into will be taken out of play, and a member of the team whose cup was eliminated must drink the beer or other beverage contained in the cup. Depending upon the number of cups remaining, the cups may be rearranged into a diamond configuration or other configuration as cups are eliminated. The objective is to eliminate the opposing team's cups first, and the victor is the team that does so.

Setting up the cups into a tight configuration of rows forming the triangle with the rims of the cups abutting one another can take some time. Moreover, the cups can slip or slide on the table. Finally, the game can take long enough so that, by the time the game is finished, the last few cups of beer to be eliminated are warm, diminishing enjoyment of the game, and the remaining cups for the winning team may simply be discarded because the beer is too warm and flat. Consequently, there is a need for a device that enables quick setup, that retains the cups in a tight configuration, and that keeps the beverage chilled during a game of Beer-Pong or Beirut.

Thus a cup holder for a drinking game solving the aforementioned problems is desired.

SUMMARY OF THE INVENTION

The cup holder for a drinking game is a triangular multi-cup beverage tray and freezer pack insert that holds and chills multiple cups in a "billiard ball rack" formation for use in the drinking game "Beer-Pong," "Beirut," or variations thereof. The cup holder for a drinking game includes cup pockets, indentations or channels in a triangular row formation (front to back) of one cup, two cups, three cups, etc., which are formed in the freezer pack. The cup holding freezer pack fits into the triangular tray for added stability. Rubber or neoprene feet are disposed symmetrically on an underside of the bottom of the tray to provide traction during use. Preferably, the placement and depth of the cup pockets provide for the correct orientation of the cups for optimal playing of the drinking game with standard 16-ounce party cups.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
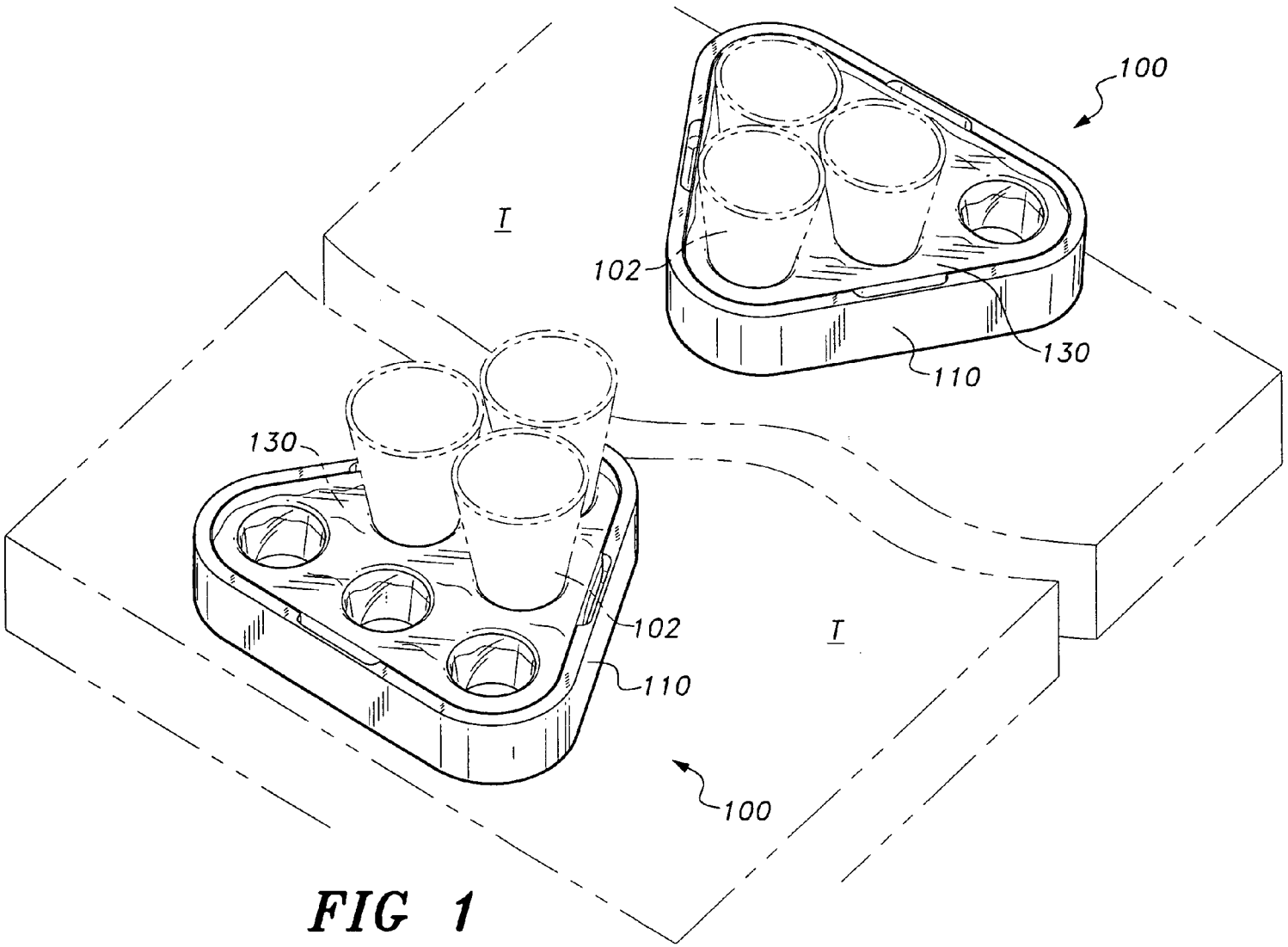
FIG. 1 is an environmental, perspective view of a cup holder for a drinking game according to the present invention.

The present invention is a cup holder for a drinking game, designated generally as 100 in the drawings. The drinking game is "Beer-Pong," "Beirut," or variations thereof. FIG. 1 shows a pair of cup holders 100 disposed at opposite ends of a table T that provides a playing surface for the game. Table T may be a regulation ping-pong table (with the center net removed), a dining table, a conference table, or any other elongated table or flat surface having suitable dimensions for use as a playing surface. The cup holders 100 are disposed adjacent the axial edge of the ends of the table T and centered between the lateral sides of the table T. The cup holders 100 support a plurality of cups 102 positioned rim-to-rim in a generally triangular configuration, the cups 102 being dimensioned to contain a beverage, preferably beer.

Figure 2:
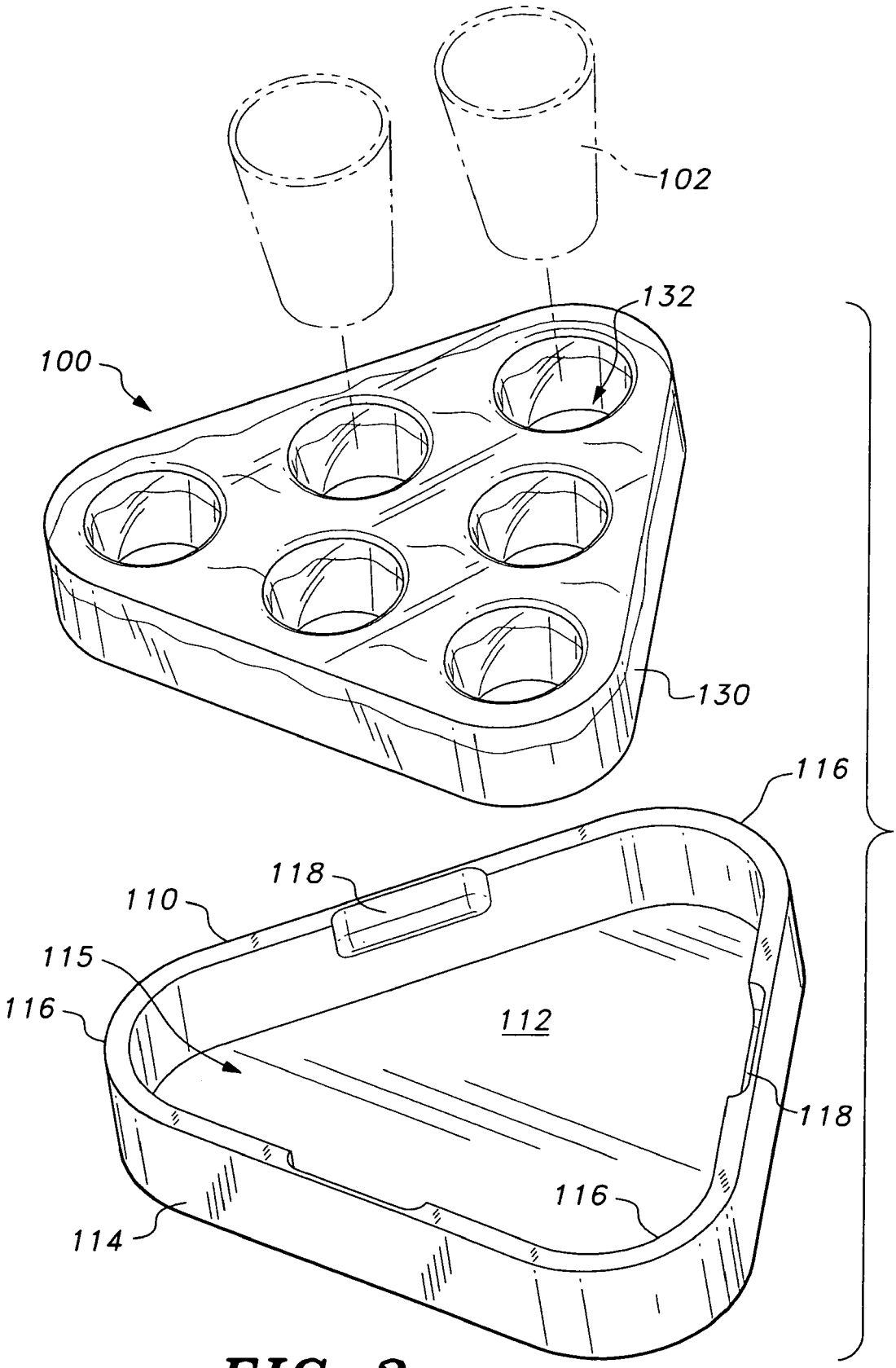
FIG. 2 is a perspective view of the cup holder for a drinking game according to the present invention.

Referring to FIG. 2, each cup holder 100 comprises a tray 110 and a freezer pack 130. Tray 110 has a generally flat, triangular bottom wall 112 and an upright peripheral wall 114 extending about the periphery of the bottom wall 112 that defines a generally triangular well 115 or recess. The vertices or corners 116 of the bottom wall 112 and peripheral wall 114 may be rounded, similar to a billiard ball rack, for ease in handling and to prevent the ping-pong ball from striking a sharp edge. The upper edges of the peripheral wall 114 may have a plurality of notches 118 or handholds defined therein for ease in lifting and carrying the tray 110, particularly when the tray 110 is loaded with cups 102.

The walls 112 and 114 of the tray 110 may be made from any-material having sufficient strength and rigidity to support the freezer pack 130 and a plurality of cups 102 filled with beverages, and to provide lateral support for the freezer pack 130. For example, the tray 110 may be made from plastic, wood, metal, stiff cardboard, laminates, or any other structural material. The walls 112 and 114 may be made from a material that provides thermal insulation, or may be made with a double wall construction having thermal insulation between the walls. The thermal insulation may be provided by styrofoam, fiberglass, air (in the case of double wall construction), or any other material that helps to keep the freezer pack 130 chilled.

The freezer pack 130 is also generally triangular in shape, having an outer perimeter dimensioned and configured for fitting snugly within well or recess 115. The freezer pack 130 has an outer shell 133 disposed over a refrigerant or gel 134 formulated to retain cold temperatures. Thermal cooling characteristics of the freezer pack 130 should maintain refrigerated temperatures from approximately 35° F. to approximately 50° F. Preferably, the freeze point of freezer pack 130 should be approximately 28° F. The freezer pack 130 may be made from any materials conventionally known in the art for making freezer packs or cold packs, which are well known in the art. However, the outer shell 133 of the freezer pack 130 has sufficient rigidity to maintain a plurality of cup pockets 132, indentations, channels, recesses, wells, or the like defined therein. The cup pockets 132 are arranged in a generally triangular or pyramid pattern in rows that have a progressively increasing number of pockets 132 in arithmetic sequence, i.e., 1, 2, 3, n . . . .

The drawings show a freezer pack 130 having six cup pockets 132 defined therein. However, it will be understood that the number of cup pockets 132 is not critical. In some areas the game of Beer=Pong is played with ten cups, so that the freezer pack may be made with ten cup pockets 132 defined therein arranged in four rows.

Figure 3:
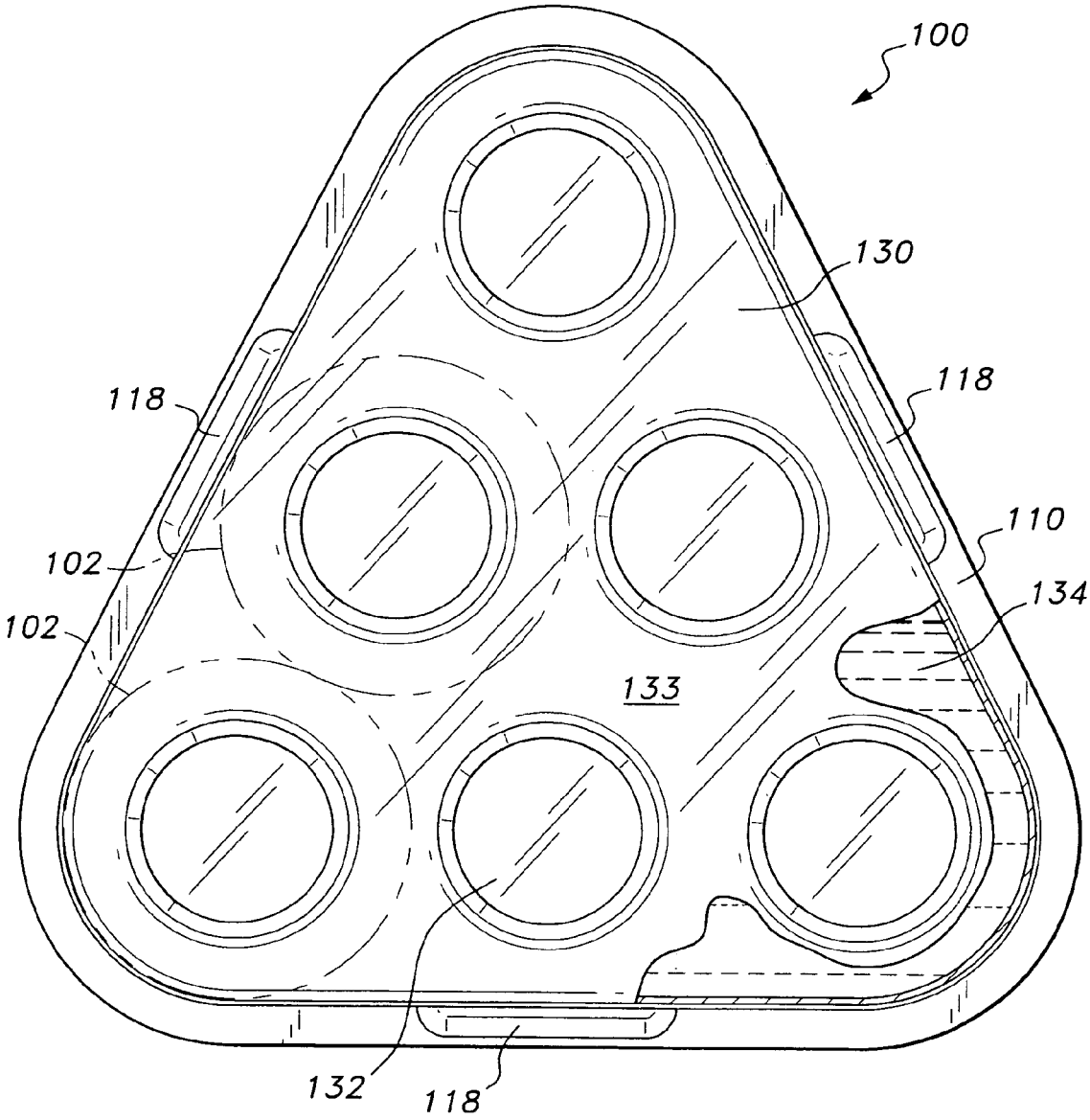
FIG. 3 is a top view of the cup holder for a drinking game according to the present invention, with a portion of the freezer pack broken away.

The cup pockets 132 may have any desired shape. In one preferred embodiment, however, the cup pockets 132 have a frustoconical shape, being narrow in diameter at the base and progressively increasing in diameter to the top of the pocket 132, being adapted to receive conventional frustoconical plastic party cups, usually of 16-ounce capacity. The cups may be filled to the top, but are usually only half-filled to allow room for receiving the ping-pong ball, and to reduce splashing. As shown in FIG. 3, the cup pockets 132 are spaced apart in such a manner that the outer rims of the cups 132 abut each other, i.e., the rims of adjacent cups 102 are touching each other, or are spaced apart by no more than 1-3 mm, when the cups 102 are placed in the pockets 132.

Figure 4:
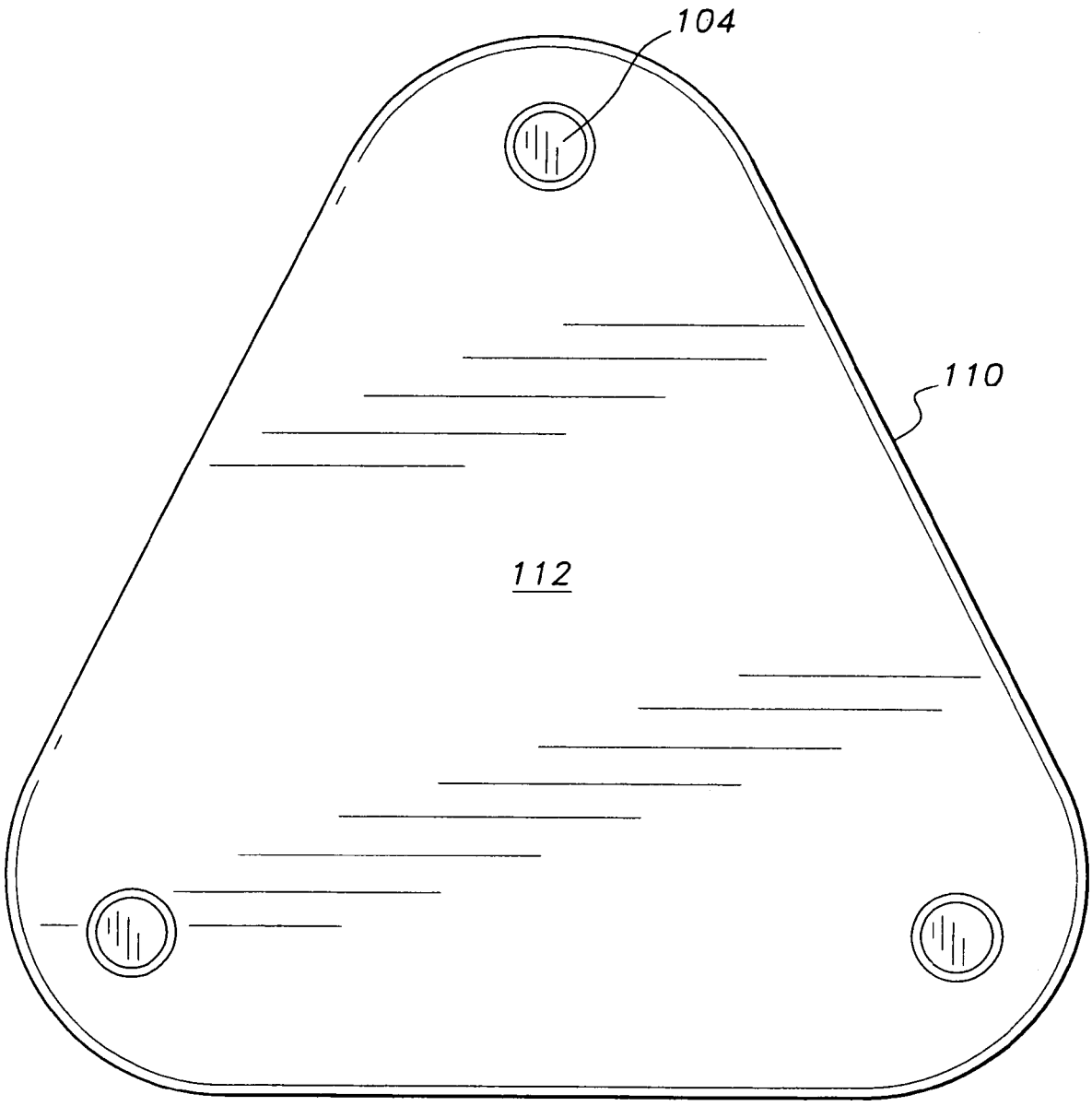
FIG. 4 is a bottom view of the cup holder for a drinking game according to the present invention.

As shown in FIG. 4, the tray 110 may have rubber or neoprene feet 140 disposed on the bottom surface of bottom wall 112. The feet 140 raise the tray 110 above the playing surface, making it easier to lift the tray 110, and also provide traction to prevent the tray 110 from sliding on the playing surface. Alternative, the bottom surface of bottom wall 112 may have ribs or corrugations projecting from the bottom surface for the same purposes.

In use, a pair of freezer packs 130 may be placed in a freezer or refrigerator to chill before playing the game. When ready to play Beer-Pong, the freezer packs 132 are removed from the freezer and placed in trays 110. Cups 102 are placed in the cup pockets 132 and filled with beer or other beverage of choice, and the trays 110 are placed at opposing ends of a table T or other playing surface. The cup holders 100 keep the cups 102 aligned and in uniform configuration at both ends of the table T, and keep the beer or other beverage chilled so that the losing team's enjoyment of the game does not diminish because of the duration of the game, and the winning team is suitably rewarded by having several chilled beverages remaining when play has ended. Freezer packs 130 are reusable, and trays 110 may be reusable or disposable.

It is to be understood that the present invention is not limited to the embodiment described above, but encompasses any and all embodiments within the scope of the following claims.

We claim:

1. A cup holder for a drinking game, comprising:

a tray having a bottom wall and an upright wall extending about a periphery of the bottom wall, the tray defining a substantially triangular well; and a triangular freezer pack removably disposed in the well defined by the tray, the freezer pack having a plurality of cup holding pockets defined therein, the pockets being disposed in rows forming a triangular pattern adapted for receiving a plurality of drinking cups and maintaining the drinking cups in the triangular pattern with rims of adjacent drinking cups substantially abutting each other.

2. The cup holder for a drinking game according to claim 1, wherein the bottom wall of the tray is generally flat, being adapted for placement on a flat playing surface.

3. The cup holder for a drinking game according to claim 1, wherein said tray has rounded corners for ease of handling.

4. The cup holder for a drinking game according to claim 1, wherein said tray has a plurality of handholds defined therein for lifting and carrying said tray when loaded with cups.

5. The cup holder for a drinking game according to claim 1, wherein the walls of said tray are formed from at least one material selected from the group consisting of plastic, wood, metal, stiff cardboard, and laminates.

6. The cup holder for a drinking game according to claim 1, wherein the walls of said tray are made from a material providing thermal insulation for said freezer pack.

7. The cup holder for a drinking game according to claim 1, wherein the walls of said tray comprise a double wall construction having a thermal insulation material between the walls.

8. The cup holder for a drinking game according to claim 1, wherein the freezer pack has a triangular outer perimeter dimensioned and configured for fitting snugly within the well defined by said tray.

9. The cup holder for a drinking game according to claim 1, wherein said freezer pack has a gel formulated to retain cold temperatures and an outer shell disposed over the gel.

10. The cup holder for a drinking game according to claim 1, wherein said freezer pack has thermal cooling characteristics that can maintain refrigerated temperatures from about 35° F. to about 50° F.

11. The cup holder for a drinking game according to claim 1, wherein said freezer pack has a freeze point of about 28° F.

12. The cup holder for a drinking game according to claim 1, wherein the cup pockets are arranged in rows that have a progressively increasing number of pockets in the arithmetic sequence, 1, 2, 3, . . . n.

13. The cup holder for a drinking game according to claim 1, wherein said tray comprises six cup pockets defined therein arranged sequentially in rows of one cup pocket, two cup pockets, and three cup pockets, respectively.

14. The cup holder for a drinking game according to claim 1, wherein the cup pockets are frustoconical in shape, being narrow in diameter at a base of the pocket and progressively increasing in diameter to a top of the pocket, thereby being adapted for receiving frustoconical party cups.

15. The cup holder for a drinking game according to claim 1, further comprising a plurality of feet disposed on the bottom wall for to raising the tray slightly above a playing surface and to provide traction thereon.

16. A cup holder for a drinking game, comprising:

a tray having a bottom wall and an upright peripheral wall extending around a periphery of the bottom wall, the tray defining a well; and a freezer pack removably disposed in the well, the freezer pack having a plurality of cup pockets defined therein arranged in a geometric pattern, the cup pockets being adapted for supporting beverage cups, the freezer pack being adapted for keeping a beverage in the beverage cups chilled during play of the drinking game, wherein said tray and said freezer pack are triangular in shape, the cup pockets being arranged in a triangular pattern, whereby the tray and freezer pack are adapted for keeping a plurality of cups of beer chilled throughout a game of Beer-Pong.

* * * * *